US008485081B2

(12) United States Patent
Kim et al.

(10) Patent No.: US 8,485,081 B2
(45) Date of Patent: Jul. 16, 2013

(54) SYNTHETIC FIBER ROPE FOR CRANE AND METHOD OF MANUFACTURING THE SAME

(75) Inventors: Do-kyoun Kim, Busan (KR); Yong-sik Yim, Busan (KR)

(73) Assignee: DSR Corp. (KR)

( * ) Notice: Subject to any disclaimer, the term of this patent is extended or adjusted under 35 U.S.C. 154(b) by 0 days.

(21) Appl. No.: 13/445,168

(22) Filed: Apr. 12, 2012

(65) Prior Publication Data

US 2012/0260620 A1 Oct. 18, 2012

(30) Foreign Application Priority Data

Apr. 12, 2011 (KR) ..... 10-2011-0033685

(51) Int. Cl.
*D04C 1/02* (2006.01)

(52) U.S. Cl.
USPC ..... 87/6; 57/210

(58) Field of Classification Search
USPC ..... 57/210, 211, 231, 236, 237; 87/6, 87/8, 9
See application file for complete search history.

(56) References Cited

U.S. PATENT DOCUMENTS

| | | | | | |
|---|---|---|---|---|---|
| 2,176,422 | A * | 10/1939 | Howell | 57/211 |
| 2,469,178 | A * | 5/1949 | Salvans | 87/6 |
| 3,090,277 | A * | 5/1963 | Schmittmann | 87/8 |
| 3,451,305 | A * | 6/1969 | Johnson et al. | 87/6 |
| 3,805,667 | A * | 4/1974 | Orser | 87/6 |
| 4,170,921 | A * | 10/1979 | Repass | 87/6 |
| 4,321,854 | A * | 3/1982 | Foote et al. | 87/6 |
| 4,563,869 | A * | 1/1986 | Stanton | 57/211 |
| 4,640,178 | A * | 2/1987 | Kurzbock | 87/6 |
| 4,640,179 | A * | 2/1987 | Cameron | 87/6 |
| 4,947,727 | A * | 8/1990 | Momoi | 87/12 |
| 5,296,292 | A * | 3/1994 | Butters | 428/375 |
| 5,852,926 | A * | 12/1998 | Breedlove | 57/210 |
| 5,901,632 | A * | 5/1999 | Ryan | 87/13 |
| 5,931,076 | A * | 8/1999 | Ryan | 87/8 |
| 5,934,168 | A * | 8/1999 | Feichtinger et al. | 87/8 |
| 7,047,860 | B2 * | 5/2006 | Faborsky | 87/6 |
| 7,228,777 | B2 * | 6/2007 | Morissette et al. | 87/5 |
| 7,331,269 | B2 * | 2/2008 | He et al. | 87/6 |
| 7,703,371 | B2 * | 4/2010 | Morissette et al. | 87/5 |
| 7,703,372 | B1 * | 4/2010 | Shakespeare | 87/6 |
| 8,109,071 | B2 * | 2/2012 | Gilmore | 57/211 |
| 2003/0005681 | A1 * | 1/2003 | He et al. | 57/210 |
| 2005/0229770 | A1 * | 10/2005 | Smeets et al. | 87/8 |
| 2009/0282801 | A1 * | 11/2009 | Gilmore | 57/237 |
| 2010/0162882 | A1 * | 7/2010 | Shakespeare | 87/6 |

* cited by examiner

*Primary Examiner* — Shaun R Hurley
(74) *Attorney, Agent, or Firm* — Park & Associates IP Law, P.C.

(57) ABSTRACT

Synthetic fiber rope for a crane, include a central strand having an inner core made of a synthetic resin and an inner cover made of synthetic fibers and connected to the inner core via braiding, a plurality of outer strands each of which includes an outer core made of a synthetic resin and an outer cover made of synthetic fibers and connected to the outer core via twisting and which are connected to the outer surface of the central strand via braiding, and a jacket made of synthetic fibers and braided to cover the surface of the plurality of outer strands. Method of manufacturing a synthetic fiber rope is also disclosed.

10 Claims, 2 Drawing Sheets

SYNTHETIC FIBER ROPE FOR CRANE AND METHOD OF MANUFACTURING THE SAME

REFERENCE TO RELATED APPLICATIONS

This application claims the priority benefit of Korean Application No. 10-2011-0033685 filed on Apr. 12, 2011, the entire contents of which are incorporated herein by reference.

FIELD OF THE INVENTION

The present invention relates to a rope for a crane and a method of manufacturing the same, and, more particularly, to a synthetic fiber rope for a crane, which includes synthetic fibers and is mounted to a crane used to lift heavy objects and to a method of manufacturing the same.

BACKGROUND OF THE INVENTION

Ropes for cranes typically include wire ropes formed by twisting steel wires.

The wire ropes are configured such that a core is disposed at the center thereof and a plurality of strands is twisted around the core. As such, each strand may be formed by twisting a plurality of fine filaments.

Because such wire ropes hold very heavy objects such as containers when used in a crane, they are designed to have at least a predetermined diameter or thickness in order to ensure strength or durability.

However, the wire ropes formed of steel are problematic because a tip load at the boom tip of a crane is drastically reduced due to the self-weight of steel wire rope in proportion to an increase in the height of a building. For example, in the case where a steel wire rope having a diameter of 36 mm is used in a 25-ton crane having a maximum work radius of 52.5 Mtr, the tip load of the crane is 2.3 tons. However, when a super fiber rope is used, the tip load is 6.8 tons, which is a 300% increase.

Furthermore, in the case where the capacity of the crane is increased to enhance the tip load of the crane in a super high-rise building, the self-weight of the crane increases. Accordingly, because a tower crane which is used in a state of being fixed to the outer wall of the building may have a considerable influence on the building, the outer wall of the building is designed to be much thicker, or severe problems may result if it is difficult to change the design of the building because of the features of the building.

As well, to avoid the problems caused by the use of such steel wire ropes, a plurality of cranes is conventionally used at different heights of the super high-rise building. However, the working time may increase due to lifting work undesirably decreasing work efficiency and lengthening the construction period.

Upon construction of a high-rise building, when conventional steel wire ropes are used in a crane, strength or durability is ensured but the self-weight thereof is large and thus the tip load of the crane is remarkably decreased. In order to increase the tip load of the crane, the capacity of the crane should be increased. In this case, however, the weight of the crane body may increase, undesirably placing additional burdens on the design of the building. Furthermore, as the height of the building increases, equipment is made complicated, and lifting efficiency may decrease, undesirably generating a variety of problems including a long construction period.

Because of such problems, ropes made of synthetic fibers (in particular high-strength super fibers) conventionally employed in different end uses may be utilized. Conventional synthetic fiber ropes are disadvantageous because the circular cross-section thereof is deformed into a flat oval shape due to the lifting load when wound on the drum of a tower crane, and also because the deformation shape is non-uniform, making it impossible to form an aligned winding. In the case where such an aligned winding is not formed, there may occur a phenomenon in which the rope is caught between the underlying rope turns of the non-aligned winding upon lifting high loads by the crane. When the caught rope is released between the underlying rope turns during unwinding at high speed, an impact may be applied to the rope, undesirably causing problems of the lifting object swinging or falling. Where such an impact may accumulate, the lifetime of the rope may be decreased, and the rope may be damaged attributable to loads intensively applied to a specific portion thereof. Moreover, irregular winding on a crane drum may increase the winding volume, undesirably generating a variety of problems including causing friction with a portion close to the drum to thereby directly break the ropes.

SUMMARY OF THE INVENTION

Accordingly, exemplary embodiments of the present invention provide a synthetic fiber rope for a crane, which has a much lower self-weight and equivalent tensile strength compared to conventional wire ropes for cranes, and a method of manufacturing the same.

Also exemplary embodiments of the present invention provide a synthetic fiber rope for a crane, in which the cross-section of the rope may be maintained in a circular shape under a variety of use conditions and the rope may thus be accurately wound on a drum while reducing friction thereby decreasing damage thereto, and a method of manufacturing the same.

An aspect of the present invention provides a synthetic fiber rope for a crane, comprising a central strand comprising an inner core made of a synthetic resin and an inner cover made of synthetic fibers and connected to the inner core by means of braiding; a plurality of outer strands each comprising an outer core made of a synthetic resin and an outer cover made of synthetic fibers and connected to the outer core by means of twisting, the plurality of outer strands being connected to the outer surface of the central strand by means of braiding; and a jacket made of synthetic fibers and braided to cover a surface of the plurality of outer strands.

As such, an adhesive may be inserted between the outer core and the outer cover so that the outer cover is bound to the outer core.

Furthermore, the adhesive may comprise a copolymer of acryl and urethane.

Also, a coating layer may be formed between the outer strands and the jacket so as to prevent slipping therebetween.

The coating layer may comprise polyurethane.

Also, the inner core or the outer core may be a mono strand composed of nylon or polyester.

Also, one or more selected from among the inner cover, the outer cover and the jacket may be composed of any one selected from among ultra high molecular weight polyethylene (UHMWPE) fibers, Vectran fibers, carbon fibers, and aramid fibers.

Another aspect of the present invention provides a method of manufacturing a synthetic fiber rope for a crane, comprising braiding an inner cover made of synthetic fibers on an inner core made of a synthetic resin, thus forming a central strand; twisting outer covers made of synthetic fibers on outer cores made of a synthetic resin, thus forming a plurality of outer strands, and braiding the plurality of outer strands on the outer surface of the central strand; and braiding a jacket made of synthetic fibers on the surface of the outer strands with pressing and tensing the braided outer stands.

Also, applying an adhesive on the outer cores may be performed before twisting the outer covers on the outer cores.

Also, forming a coating layer on and in the outer strands braided on the outer surface of the central strand may be performed before braiding the jacket.

BRIEF DESCRIPTION OF THE DRAWINGS

The features and advantages of the present invention will be more clearly understood from the following detailed description taken in conjunction with the accompanying drawings, in which.

DETAILED DESCRIPTION OF THE INVENTION

Hereinafter, preferred embodiments of the present invention will be described in detail with reference to the accompanying drawings. It is to be noted that the following description and the appended drawings are proposed to further understanding the present invention and the scope of the present invention is not limited thereto. Also when conventional configurations and functions may make the gist of the present invention unclear, a detailed description thereof will be omitted.

Figure 1:
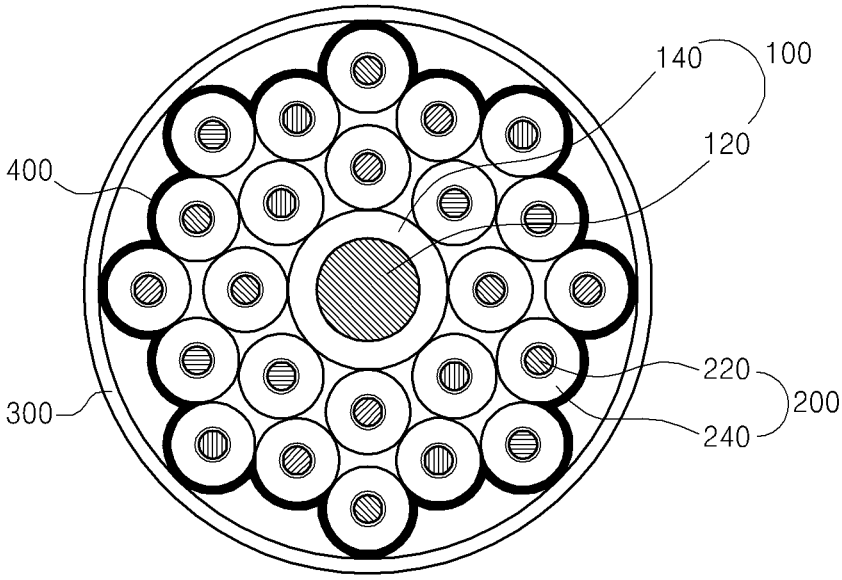
FIG. 1 is a cross-sectional view showing the structure of a synthetic fiber rope for a crane according to a preferred embodiment of the present invention.

FIG. 1 is a cross-sectional view showing the structure of a synthetic fiber rope for a crane according to a preferred embodiment of the present invention.

With reference to FIG. 1, the rope of the present invention may include a central strand 100, outer strands 200 and a jacket 300.

First, the central strand 100 will be described below.

The central strand 100 is disposed at the center of the rope and may include an inner core 120 and an inner cover 140.

The inner core 120 is preferably made of a synthetic resin material, for example nylon or polyester that has high resistance to repetition and bending and superior restorability. Alternatively, another type of synthetic resin having similar weight, strength and elasticity may be used.

The inner core 120 may be a mono strand.

Also the inner cover 140 may be made of synthetic fibers and may be connected to the inner core 120 in a braiding manner, and preferably comprises synthetic fibers referred to as super fibers (strength of 20 g/d or more, brake elongation of 3.8% or less).

Among the super fibers, ultra high molecular weight polyethylene (UHMWPE) fibers, Vectran fibers, carbon fibers or aramid fibers may be used.

Figure 2:
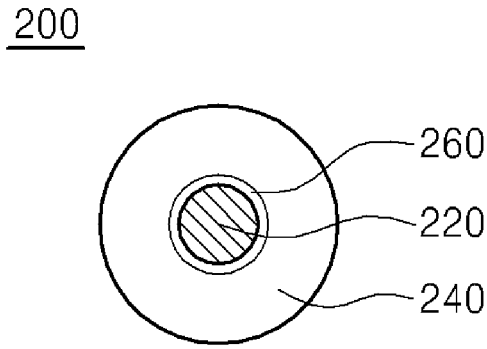
FIG. 2 is a cross-sectional view showing the structure of the outer strand of FIG. 1.

With reference to FIG. 2, the outer strands 200 are described. FIG. 2 is a cross-sectional view showing the structure of the outer strand of FIG. 1.

A plurality of outer strands 200 is provided and is connected to the outer surface of the central strand 100 in a braiding manner.

Each of the outer strands 200 is configured such that an outer cover 240 is connected to an outer core 220 in a twisting manner.

The outer core 220 may be a mono strand made of a synthetic resin, in particular, nylon or polyester, like the inner core 120.

The outer core 220 has a diameter comparatively smaller than that of the inner core 120.

The outer cover 240 is made of synthetic fibers, and preferably super fibers like the inner cover 140, and in particular, any one selected from among UHMWPE fibers, Vectran fibers, carbon fibers and aramid fibers may be used.

As shown in FIG. 2, an adhesive 260 may be inserted between the outer core 220 and the outer cover 240. The adhesive 260 may be used to fixedly bind the outer cover 240 to the outer core 220.

In the case where the outer cores 220 are not treated with the adhesive 260, when the outer strands 200 are braided, the outer cores 220 are separated from the outer covers 240 making it impossible to perform braiding. Even when the outer strands 200 are braided in a state of the outer cores 220 being separated from the outer covers 240, friction may occur between the outer cores 220 due to tensile repetition during the use of the rope, and consequently the outer cores 220 may be cut in the rope during use.

For reference, the adhesive 260 comprises a copolymer of acryl and urethane and may be prepared to have a solid content of about 44% in toluene and ethylacetate solvents. This adhesive is a viscous liquid having yellow color and transparency with a viscosity of about 5300±1000 cps.

The jacket 300 is a protective layer that covers the outer surface of the plurality of outer strands 200 connected to the central strand 100, and is made of synthetic fibers.

The jacket 300 may include synthetic fibers, in particular, super fibers. Specifically, any one selected from among UHMWPE fibers, Vectran fibers, carbon fibers and aramid fibers may be used. The connection may be performed in a braiding manner.

As such, a coating layer 400 is preferably formed on and in the outer strands 200 and the jacket 300.

The coating layer 400 functions to prevent slipping between the outer strands 200 and the jacket 300 and to reduce inner frictional heat caused by friction between fibers thus increasing the lifetime of the rope. Specifically, because the rope for a crane is repeatedly wound on or unwound from the drum, it is exposed to external force such as tension, wrenching, etc. Where the outer strands 200 are worn and damaged due to friction or are separated from the jacket 300 and thus an impact load is applied thereto, the jacket 300 may be broken. Hence, the lifetime of the rope may be shortened. In the present invention, the formation of the coating layer 400 may alleviate the above problems.

The coating layer 400 may be composed of polyurethane.

Compared to conventional wire ropes, the rope having the above structure according to the present invention has similar tensile strength, but has a self weight of only ⅕~1/10, and enhanced durability to repetitive bending and wrenching of the inner core 120 and the outer cores 220, and the elasticity and shape of the rope are maintained.

Figure 3:
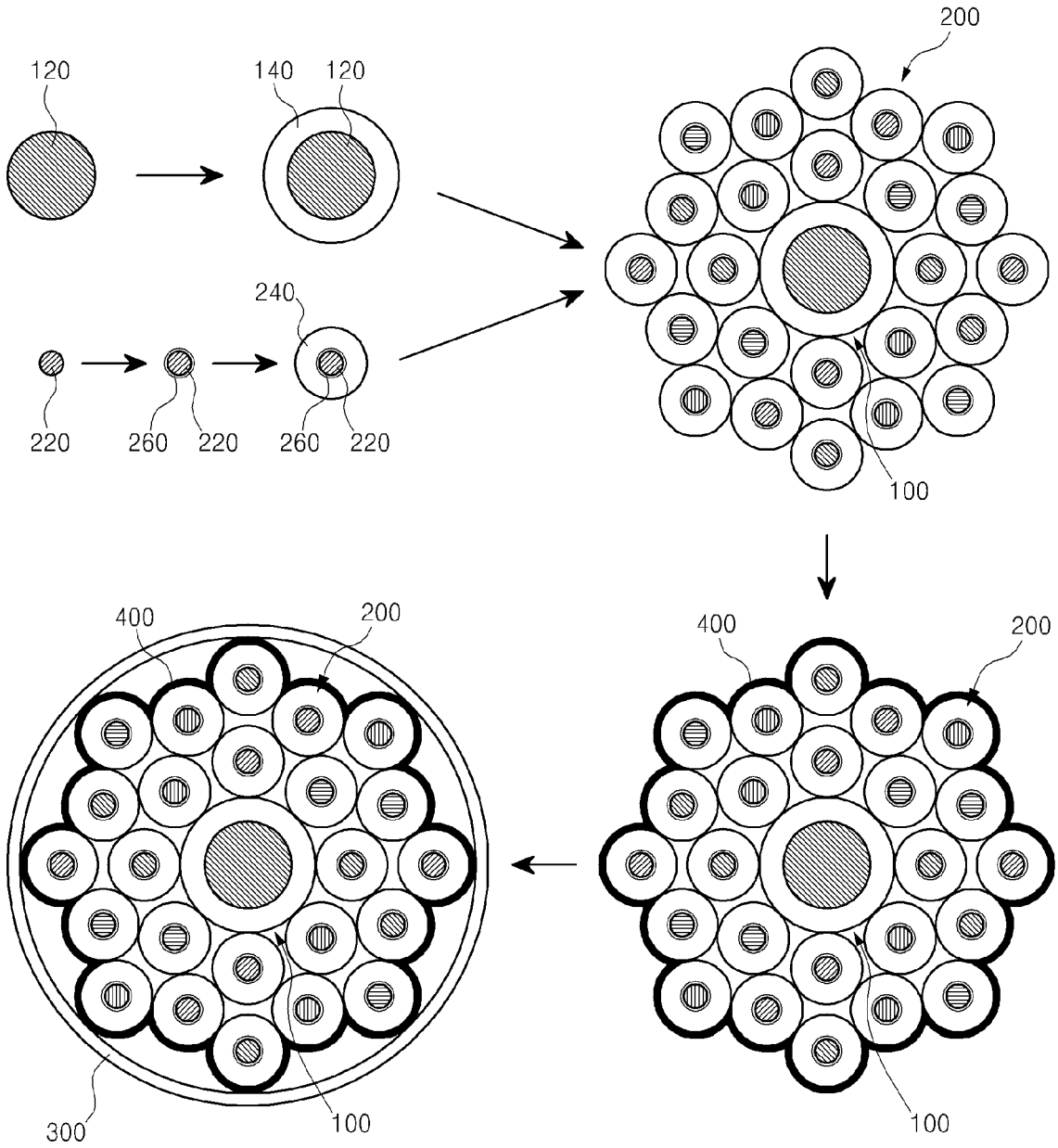
FIG. 3 is of schematic views showing a process of manufacturing the synthetic fiber rope for a crane according to another preferred embodiment of the present invention.

With reference to FIG. 3, a manufacturing method according to the present invention is described below. FIG. 3 illustrates a process of manufacturing the synthetic fiber rope for a crane according to another embodiment of the present invention.

The inner cover 140 made of synthetic fibers such as super fibers is braided on the inner core 120 of a mono strand made of a synthetic resin such as nylon or polyester thus forming the central strand 100.

Also, the adhesive 260 is applied on outer cores 220 each comprising a mono strand made of a synthetic resin such as nylon or polyester, and outer covers 240 made of synthetic fibers such as super fibers are twisted, thus forming a plurality of outer strands 200.

The plurality of outer strands 200 is braided on the outer surface of the central strand 100.

The coating layer 400 in a liquid phase comprising polyurethane is applied on and in the plurality of outer strands 200 thus braided, after which the jacket 300 made of synthetic fibers such as super fibers is braided on the plurality of outer strands 200 with pressing and tensing the outer stands, thereby completing the synthetic fiber rope of the present invention.

Specifically, the jacket 300 is firmly attached and braided on the plurality of braided outer strands 200 with pressing and tensing the outer stands as mentioned above, thus reducing the volume of the rope itself and preventing the deformation of the rope by an external force.

Thus when the rope is wound on the drum, the distortion of the circular cross-section of the rope or the deformation thereof into an oval shape due to bending, compression, tension or the like may be minimized, and thus the rope may be accurately wound on the drum, and also friction between the ropes may be greatly decreased.

As described hereinbefore, the present invention provides a synthetic fiber rope for a crane and a method of manufacturing the same. In exemplary embodiments of the present invention, the rope has a very low self-weight thanks to the use of synthetic resin and synthetic fibers thus greatly increasing the lifting load of the crane in a high-rise building to thereby enhance the capacity of the crane. When the capacity of the crane is increased in this way, excluding the use of a large crane in a high-rise building reduces the burden placed on building design and remarkably decreases equipment costs.

Upon construction of a super high-rise building, two to four cranes are conventionally mounted per height to perform a lifting process, but where the rope made of super fibers for a crane is used, the capacity of the crane can increase and thus one-step lifting is possible, ultimately increasing lifting efficiency and shortening the construction period.

As well, the rope is configured and manufactured such that durability to external force such as bending, compression, tension, etc., is high, and also that friction and wear are minimized, thus minimizing the deformation of the rope and prolonging the lifetime of the rope.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A synthetic fiber rope for a crane, comprising:

a central strand comprising an inner core made of a synthetic resin and an inner cover made of synthetic fibers and connected to the inner core by means of braiding;

a plurality of outer strands each comprising an outer core made of a synthetic resin and an outer cover made of synthetic fibers and connected to the outer core by means of twisting, the plurality of outer strands being connected to an outer surface of the central strand by means of braiding; and a jacket made of synthetic fibers and braided to cover a surface of the plurality of outer strands.

2. The synthetic fiber rope of claim 1, wherein an adhesive is inserted between the outer core and the outer cover so that the outer cover is bound to the outer core.

3. The synthetic fiber rope of claim 2, wherein the adhesive comprises a copolymer of acryl and urethane.

4. The synthetic fiber rope of claim 1, wherein a coating layer is formed between the outer strands and the jacket so as to prevent slipping therebetween.

5. The synthetic fiber rope of claim 4, wherein the coating layer comprises polyurethane.

6. The synthetic fiber rope of claim 1, wherein the inner core or the outer core is a mono strand composed of nylon or polyester.

7. The synthetic fiber rope of claim 1, wherein one or more selected from among the inner cover, the outer cover and the jacket are composed of any one selected from among ultra high molecular weight polyethylene (UHMWPE) fibers, Vectran fibers, carbon fibers, and aramid fibers.

8. A method of manufacturing a synthetic fiber rope for a crane, comprising:

braiding an inner cover made of synthetic fibers on an inner core made of a synthetic resin, thus forming a central strand;

twisting outer covers made of synthetic fibers on outer cores made of a synthetic resin, thus forming a plurality of outer strands, and braiding the plurality of outer strands on an outer surface of the central strand; and braiding a jacket made of synthetic fibers on a surface of the outer strands with pressing and tensing the braided outer strands.

9. The method of claim 8, wherein applying an adhesive on the outer cores is performed before twisting the outer covers on the outer cores.

10. The method of claim 8, wherein forming a coating layer on and in the outer strands braided on the outer surface of the central strand is performed before braiding the jacket.

* * * * *